United States Patent [19]

Gerch

[11] Patent Number: 4,483,427

[45] Date of Patent: Nov. 20, 1984

[54] COMBINATION ATTACHE CASE AND TRAVELING DESK

[75] Inventor: Edward L. Gerch, Chicago, Ill.

[73] Assignee: Kingport, Ltd., Evanston, Ill.

[21] Appl. No.: 460,275

[22] Filed: Jan. 24, 1983

[51] Int. Cl.[3] ..... A45C 3/02

[52] U.S. Cl. ..... 190/11; 190/112; 190/900

[58] Field of Search ..... 190/11, 1, 42, 900, 190/901, 102, 112, 111; 150/52 B

[56] References Cited

U.S. PATENT DOCUMENTS

| | | | |
|---|---|---|---|
| 1,491,807 | 4/1924 | McLinn | 190/11 |
| 3,082,049 | 3/1963 | Lifton | 312/200 |
| 3,104,289 | 9/1963 | Segel | 179/100.1 |
| 3,112,017 | 11/1963 | Lifton | 190/11 |
| 3,773,154 | 11/1973 | Mitchell | 190/11 |
| 3,833,098 | 9/1974 | Alderman | 190/11 |
| 3,904,003 | 9/1975 | Margerum | 190/11 |
| 4,412,604 | 11/1983 | Bell et al. | 190/11 |

FOREIGN PATENT DOCUMENTS

| | | | |
|---|---|---|---|
| 3634571 | 6/1973 | Australia | 190/11 |

*Primary Examiner*—Stephen Marcus

*Assistant Examiner*—David Voorhees

*Attorney, Agent, or Firm*—James N. Videbeck

[57] ABSTRACT

A combination attache case and traveling desk includes a working desk top compartment which is formed immediately subjacent the largest wall of a case lid and is separate and distinct from the large central storage compartment forming the remainder of the attache case. The attache case includes hingedly connected box-like hollow base and lid members. In the improvement of the invention, when the case is in horizontal upright position, the upper or lid member includes a substantially flat horizontal wall defining the boundry between the major inner attache case compartment and the desk top compartment which is positioned subjacent the top peripheral edge of the lid. A substantially flat desk top compartment cover is hingedly retained on the rear of the lid and is sized to close flush with the upper peripheral border of the lid. The horizontal wall, peripheral border, and cover define a shallow compartment in which a writing paper tablet, documents and other writing or reading paraphernalia may be stored. The cover includes means for being maintained in a vertical position during use of the desk top compartment, and means for retaining documents on the inner surface thereof.

6 Claims, 5 Drawing Figures

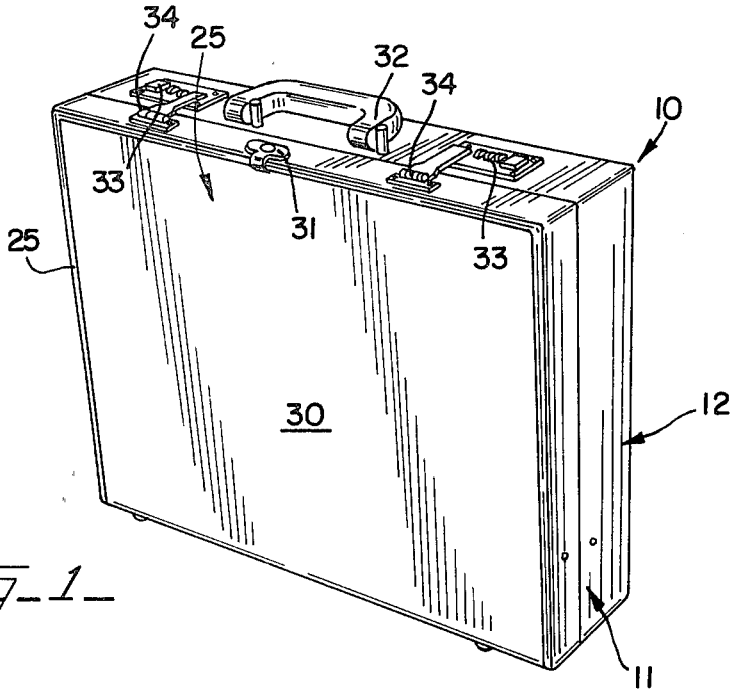
FIG. 1
FIG. 2
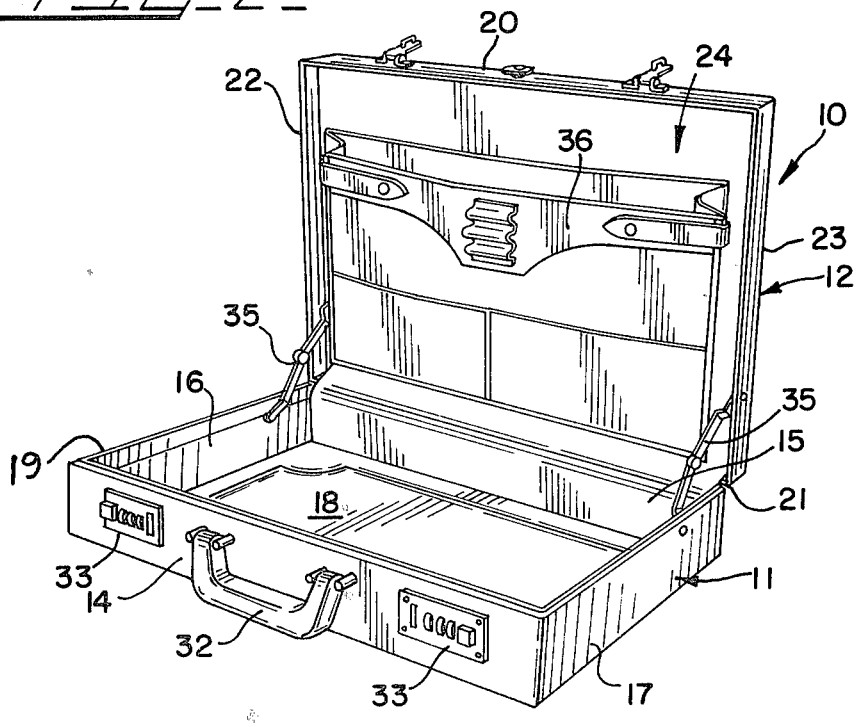

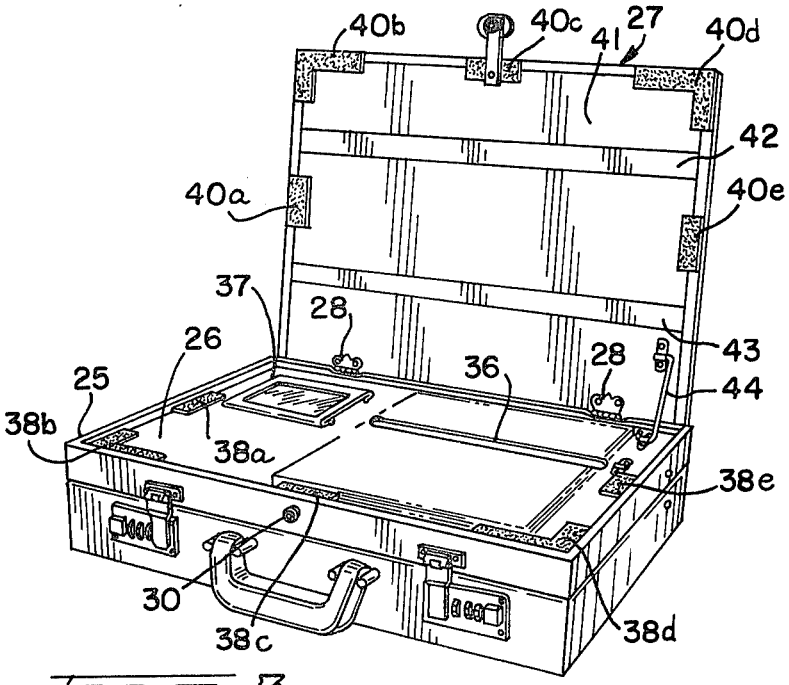
FIG. 3
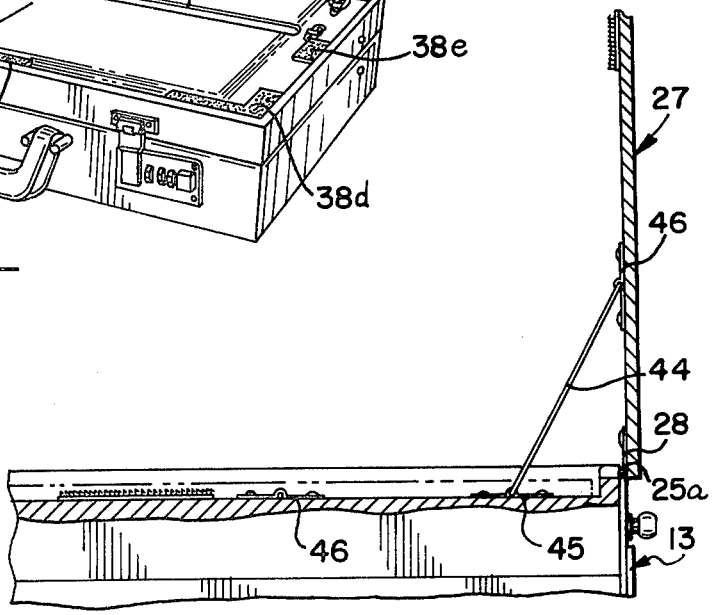
FIG. 5
FIG. 4
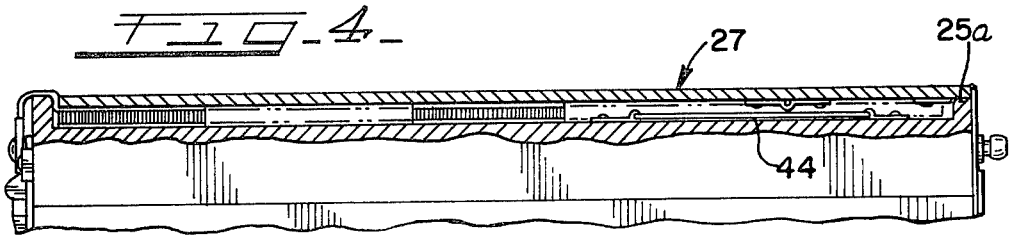

COMBINATION ATTACHE CASE AND TRAVELING DESK

BACKGROUND OF THE INVENTION

The invention relates generally to attache cases, and more particularly, to an improved attache case having a separate shallow compartment accessible directly from the outside of the case which is adapted to retain writing-reading materials thereon while providing a relatively large substantially flat rigid writing surface for use as a traveling desk top.

Certain conventional attache case have a box-like appearance with substantially rigid split side and end walls and large flat top and bottom surfaces joining the side and end walls. Such attache cases may have dimensions approximating 18–20 inches in width, 13–15 inches in depth, and a thickness which is predetermined but variable from about 2 inches to 5 inches or more. While such existing attache cases have large flat top and bottom surfaces, they do not provide a surface suitable for adequately maintaining writing and/or reading materials thereon for use as a traveling desk top. Additionally, the exterior flat surfaces of such an attache case are likely to encounter foreign objects during use which result in deformations of the large flat surfaces thus hindering their usability as writing surfaces.

Existing box-like attache cases having provision therein for containing a separate writing surface are disclosed in the following U.S. Pat. Nos. 3,082,049; 3,104,289; 3,112,017; 3,833,098; and 3,904,003. However all of these patents disclose attache cases in which the major compartment of the case, defined by the half-shell-like lid and base, must be opened to have access to the writing surface, usually a removable board which is snapped or otherwise releasably attachable to the interior of the case.

A need has developed to provide a usable horizontal work space or traveling desk feature to the conventional box-like attache case which is separate and distinct from the major storage compartment thereof.

It is therefor an object of the present invention, generally stated, to provide a new and improved attache case.

Another object of the present invention is the provision of a separate compartment in an attache case for providing traveling desk features to the case without the need for opening the major storage compartment thereof.

SUMMARY OF THE INVENTION

The invention is directed to an attache case of the type characterized by box-shape sides with an enclosable central storage area defined by opposed open mouth half-shell type members hingedly connected along one edge of each open mouth for articulated open and closing movement therebetween. One of the opposed members defines a base and the other member defines a lid. A generally flat form sustaining surface in connection with said attache case is adapted for maintaining writing materials thereon for use as a traveling desk. An improvement in the attache case of the invention is wherein the generally flat form sustaining surface is integrally formed on the lid subjacent an exterior surface thereof. A cover member is hingedly maintained on the lid adjacent, a back or rear edge of the form sustaining surface. The cover provides an exterior surface for the lid and includes a fastener thereon for selectively maintaining the cover in closed position over the form sustaining surface as desired.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

FIG. 1 is a perspective view of an improved attache case constructed in accordance with the present invention in closed position showing the traveling desk compartment cover fitting flush with the case side and end walls.

FIG. 2 is a perspective view of the improved attache case of the present invention showing the major storage compartment thereof in an open position.

FIG. 3 is a perspective view of the attache case wherein the major compartment lid is closed and the traveling desk cover is open.

FIG. 4 is a fragmentary cross sectional view taken along line 4—4 of FIG. 1.

FIG. 5 is a detail fragmentary sectional view similar to FIG. 4 wherein the cover is shown in an open position.

DETAILED DESCRIPTION OF THE PREFERRED EMBODIMENT

Referring to FIGS. 1–5, an attache case 10 constructed in accordance with the present invention includes a generally hollow box shape base 11 and, in this embodiment, a generally shallower hollow box-shape lid 12 hingedly retained on base 11 by a leather strap type hinge 13 (FIG. 5). Base 11 is characterized by rectangular front and back side walls 14,15, respectively, opposed end walls 16,17, and bottom wall 18 which all meet at right angles to define the hollow box-like structure with the upper edge of the front, back and end walls defining and open mouth rectangular base rim.

Lid 12 is also box-like in shape and, while of predetermined fixed depth in each example, is variable in depth to provide differing sized attache cases having typical depth dimensions of 2 to 5 inches or more. Lid 12, in this embodiment, includes relatively shallow front and back side walls 20, 21 and opposed end walls 22, 23, which all meet at right angles to define a rectangular framework for the lid 12. As shown most clearly in FIG. 2, the top surface of the inner large storage compartment in attache case 10 is defined by a substantially rigid wall 24 which extends or bridges across the hollow interior of the framework. The bottom edges of the rectangular walls 20–23 define an open mouth rectangular lower lid rim which is adapted for mating engagement with the base rim, It is an important feature of the present invention that wall 24 is not positioned at the upper ends of lid side and end walls 20–23 to form a C or U-shaped cross section, but is formed subjacent a rectangular top lid rim 25 defined by the upper ends of the lid side and end walls as is a web in an I-beam type structure. Together, the rim 25 and top surface 26 of wall 24 define a shallow writing or portable desk compartment positioned in attache case 10 at the top of lid 12 above the central storage compartment.

In this embodiment, an other aspect of the present invention resides in a separate and distinct external access to the portable desk compartment provided by a cover 27 which is generally flat and hingedly retained to the back wall 23 at hinges 28–28 and is sized similarly to the web or wall 24 such that when it is closed over the portable desk compartment rim 25 its outer surface 30 and its side edges fit flush with top rim 25. A snap fastener 30 on cover 27 is selectably mountable on a fastener base 31 positioned on the front lid wall 20 to maintain the cover in closed position as desired.

The remainder of the attache case is conventionally configured. The respective front walls 14 and 20 of the base and lid further include a carrying handle 32 hingedly maintained on base 14, locks 33–33 on the base, and complementary sprung latches 34–34 on the lid adapted to maintain the large central storage compartment closed as desired. The interior of the central storage compartment includes articulated retainers 35–35 positioned between the base and lid to limit the rotation travel of the lid to approximately 90° maximum from the base. An accordian style document holder 36 is mounted on the bottom of wall 24, provides filing capability, and is adapted to retain pens-pencils and small pads of paper thereon. Accordian style document holders may be fixed permanently in position or may be releasably retained as desired.

Referring to FIGS. 3, 4 and 5, the recessed mounting of the form retaining travelling desk surface 26 below the upper rim 25 of the lid framework is clearly shown. By recessing the upper surface 26 of lid wall 24 approximately $\frac{3}{8}''$ in this embodiment, the lid top rim 25 forms a retaining lip surrounding the writing or working surface of the traveling desk to retain papers, pencils and other matters on it while the user is working. As shown most clearly in FIGS. 4 and 5 the rear edge 25*a* of rim 25 may be positioned lower than the remainder of the rim an amount equal to the thickness of the cover for flush mounting of same. The ability to keep materials from falling off of a substantially flat working surface is an important aspect of the present invention which is lacking when one attempts to use the generally flat top or bottom wall of a conventional attache case as a working desk type surface.

In this embodiment an elongate slot or cut-out 36 is formed in the top surface 26 of wall 24 as a means for retaining a pad of paper thereon. Typically the cardboard backing of a pad of paper (not shown) is positioned through the slot. A business or identification card mounting 37 is also positioned on surface 26. Hook and loop cover retaining pads 38*a–e* are also positioned around the perimeter or surface 26 for maintaining the complete cover 27 in closed position by mating retaining engagement with complementary hook and loop pads 40*a–e* mounted on the inner surface 41 of cover 27 around the perimeter thereof. The hook and loop retainers prevent the cover from bowing or warping over long periods of time and maintain the flush fit of the cover against the lid. Additionally, cover 27 includes elastic document retaining straps 42–43 which are positioned horizontally across the width of the inner surface 41 of cover 27 to retain paper documents positioned therein in fixed vertical position for viewing by a user of the travelling desk. Cover 27 may be maintained in vertical open position by means of hinged fastener 44 which forms a function similar to retainers 35. As shown most clearly in FIGS. 4 and 5, fastener wire 44 is pivotally mounted to surface 26 by its base member 45 and may be slidably removably fastened to either of its secondary base members 46–46, one of which is mounted on the inside surface 4 of cover 27 and the second of which is mounted on the top surface 26 of wall 24. FIG. 5 shows the cover retained in open position by fastener 44 and FIG. 4 shows the cover in closed position with fastener 44 retained in horizontal position.

In use, the travelling desk compartment cover 27 may be opened and maintained in an upright position to allow the user to store documents in straps 42–43 and refer to same while writing on paper which is in a pad retained in slot 38 or otherwise retained on surface 26 by rim 25. Likewise, any papers, paper clips or other office materials positioned on surface 26 will not roll or slide off of the travelling desk because of the retaining rim 25. As a result a highly usable travelling desk-type surface and shallow storage facility is presented which enables a user to perform office type work while travelling and without the necessity of opening the large common storage compartment in the attache case. As shown most clearly in FIGS. 4 and 5 the travelling desk compartment is very shallow in design, but does provide a thin storage capacity having a depth approximating $\frac{1}{3}$ inch which is sufficient for storage of writing pads, papers, pens etc. in the compartment while travelling. Additionally, the flush mounting of cover 27 with the perimeter rim 25 as shown most clearly in FIG. 4 provides an extremely stable structure which will not come open while travelling unless such opening is desired.

Thus, a new and improved attache case with travelling desk capabilities has been shown and described which includes a shallow additional compartment in the top of the attache case which is accessible from the exterior thereof without opening it's major or central storage compartment, and which is usable by a traveler when the attache case is positioned either horizontally on the user's lap or on any other suitable horizontal platform means.

While one embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

The invention is claimed as follows:

1. In an attache case of the type characterized by box-shape sides and having an enclosable central storage area defined by opposed open mouth half-shell type members hingedly connected along one edge of each said open mouth for articulated open and closing movement therebetween, one of said opposed members defining a base and the other of said opposing members defining a lid, said box-shape sides of said lid defining a rectangular framework having a predetermined depth, and a generally flat working surface in connection with said attache case which is adapted for maintaining writing materials thereon for use as a traveling desk;

an improvement wherein said generally flat working surface is integrally formed on said lid as a web across the interior of said framework mediate the opposed rectangular ends thereof, one of said opposed rectangular ends on said lid defining one of said open mouths for said central storage area, the other of said opposed rectangular ends defining a raised rim for said working desk surface to maintain writing, reading, or other materials positioned on said surface when said traveling desk is being used, a cover member hingedly maintained on said lid adjacent the perimeter of said working surface, said cover providing an exterior surface of said lid and including fastener means thereon for selectively maintaining said cover in closed position over said working surface as desired, and the height of said raised rim above said working surface being greater than the thickness of said lid for providing a shallow storage space adaptable for receiving and retaining writing materials, documents, and the like therein.

2. The attache case as defined in claim 1 wherein the thickness of said raised rim is substantially the thickness of said rectangular framework.

3. The attache case as defined in claim 1 wherein the dimensions of said cover are substantially similar to the dimensions of said working surface for providing flush positioning between an outside edge of said rectangular rim and an outer surface of said cover when in closed position.

4. The attache case as defined in claim 1 further including means for maintaining said cover in an open position substantially perpendicular to said working surface when said traveling desk is in use.

5. The attache case as defined in claim 1 wherein an inner surface of said cover includes document retaining means thereon.

6. The attache case as defined in claim 1 wherein said generally flat working surface includes writing pad retaining means thereon.

* * * * *